United States Patent [19]

Pfarrwaller

[11] 4,271,872

[45] Jun. 9, 1981

[54] DRIVE MECHANISM FOR A SUB-MECHANISM OF A WEAVING MACHINE

[75] Inventor: Erwin Pfarrwaller, Winterthur, Switzerland

[73] Assignee: Sulzer Brothers Limited, Winterthur, Switzerland

[21] Appl. No.: 22,479

[22] Filed: Mar. 21, 1979

[30] Foreign Application Priority Data

Mar. 29, 1978 [CH] Switzerland ..... 3333/78

[51] Int. Cl.[3] ..... D03D 45/24

[52] U.S. Cl. ..... 139/439; 74/96

[58] Field of Search ..... 139/437, 438, 439, 449; 74/89, 96, 98, 828, 829

[56] References Cited

U.S. PATENT DOCUMENTS

| | | | |
|---|---|---|---|
| 2,538,798 | 1/1951 | Pfarrwaller | 139/439 |
| 2,696,222 | 12/1954 | Pfarrwaller | 139/439 |
| 2,788,022 | 4/1957 | Pfarrwaller | 139/439 |
| 4,127,150 | 11/1978 | Steverlynck | 139/449 |

*Primary Examiner*—Henry Jaudon

*Attorney, Agent, or Firm*—Kenyon & Kenyon

[57] ABSTRACT

The drive mechanism for a reciprocating sub-mechanism on a weaving machine, e.g. for a cam for raising a projectile into the picking line, comprises a dead-center type crank drive. The drive is pivoted to and fro continually through 180°. The connecting rod, which drives the projectile raise cam, is kept practically completely in the standstill position in the two crank standstill positions. This rod is mounted on an eccentric section of the crank pin so that small reciprocating movements of the crank in the dead-center positions due to play in the parts driving them cannot be transmitted to the connecting rod and projectile raise cam. The eccentric section of the crank pin can also be adjusted.

17 Claims, 9 Drawing Figures

DRIVE MECHANISM FOR A SUB-MECHANISM OF A WEAVING MACHINE

This invention relates to a drive mechanism for a sub-mechanism of a weaving machine. More particularly, this inventon relates to a drive mechanism for a sub-mechanism for moving a weft picking means from a return line to a picking line in a weaving machine.

Heretofore, it has been known to move a weft picking means from a return line to a picking line in a weaving machine by means of sub-mechanisms which are driven off a main drive of the weaving machine. For example, as described in Swiss Pat. No. 328,715, one known sub-mechanism has employed a cam for raising a projectile from a return line to the picking line. This cam has, in turn, been pivoted in a to and fro manner between two end positions via a cam follower and a link articulated on the follower. However, in this known construction, the "projectile raise cam" strikes against a stationary abutment in both end positions. While these abutments are necessary to obtain exact end positions of the "projectile raise cam" and hence of the weft picking projectile carried by the cam, the abutments do wear out after some time due to the frequent impact of the cam on the abutments. As a result, the cam requires replacement. Furthermore, a layer or cushion of flying dust from the machine can also accumulate on the cam such that the end positions of the cam and the projectile may become inaccurate.

Accordingly, it is an object of the invention to eliminate the need for any fixed abutments for a projectile raise cam of a weaving machine.

It is another object of the invention to eliminate any need for special guidance of a weft picking projectile of a weaving machine during picking.

It is another object of the invention to improve the movement of a weft picking projectile from a return line to a picking line in a weaving machine.

It is another object of the invention to provide a drive mechanism for a reciprocating sub-assembly of relatively long-life.

Briefly, the invention provides a transmission which is connected between a main drive and a reciprocable sub-mechanism which includes a crank drive having a crank shaft drivingly connected to the main drive for oscillation thereby with at least one reversal point of the oscillation movement of the crank shaft in the region of a dead center position of the crank drive. The crank drive further includes a driving crank pin which is driven from the crank shaft in a reciprocating manner over an arc of 180 degrees and a driven connecting rod which is articulated on the crank pin and is drivingly connected to the sub-mechanism.

The construction is such that any slight reciprocating movement of the crank pin in the dead-center positions (standstill positions and reversal points), such as may occur due to an inevitable play in the transmission between the main drive and the crank drive, will extend substantially at right angles to the length of the connecting rod. Consequently, the connecting rod cannot be moved in the direction of its length. Thus, the two end positions of the sub-mechanism are always exactly at the same place during operation.

The sub-mechanism may be constructed with a projectile raising cam which is pivotally mounted to move between a pair of end positions and which is articulated to the connecting rod.

The crank drive is such that there is no need for any fixed abutments for the projectile raise cam nor any special guidance for a projectile during picking. The cam is kept in the exact end positions simply by the crank drive, i.e. a dead-center type of crank drive. There is no need to replace abutments due to wear nor is there any need for cleaning due to the formation of layers of flying dust and the like.

The projectile raise cam and the dead-center type crank drive can operate in an unlimited fashion while maintaining the exact end positions of the cam in the dead-center positions of the crank drive.

These and other objects and advantages of the invention will become more apparent from the following detailed description and appended claims taken in conjunction with the accompanying drawings in which:

Figure 1:
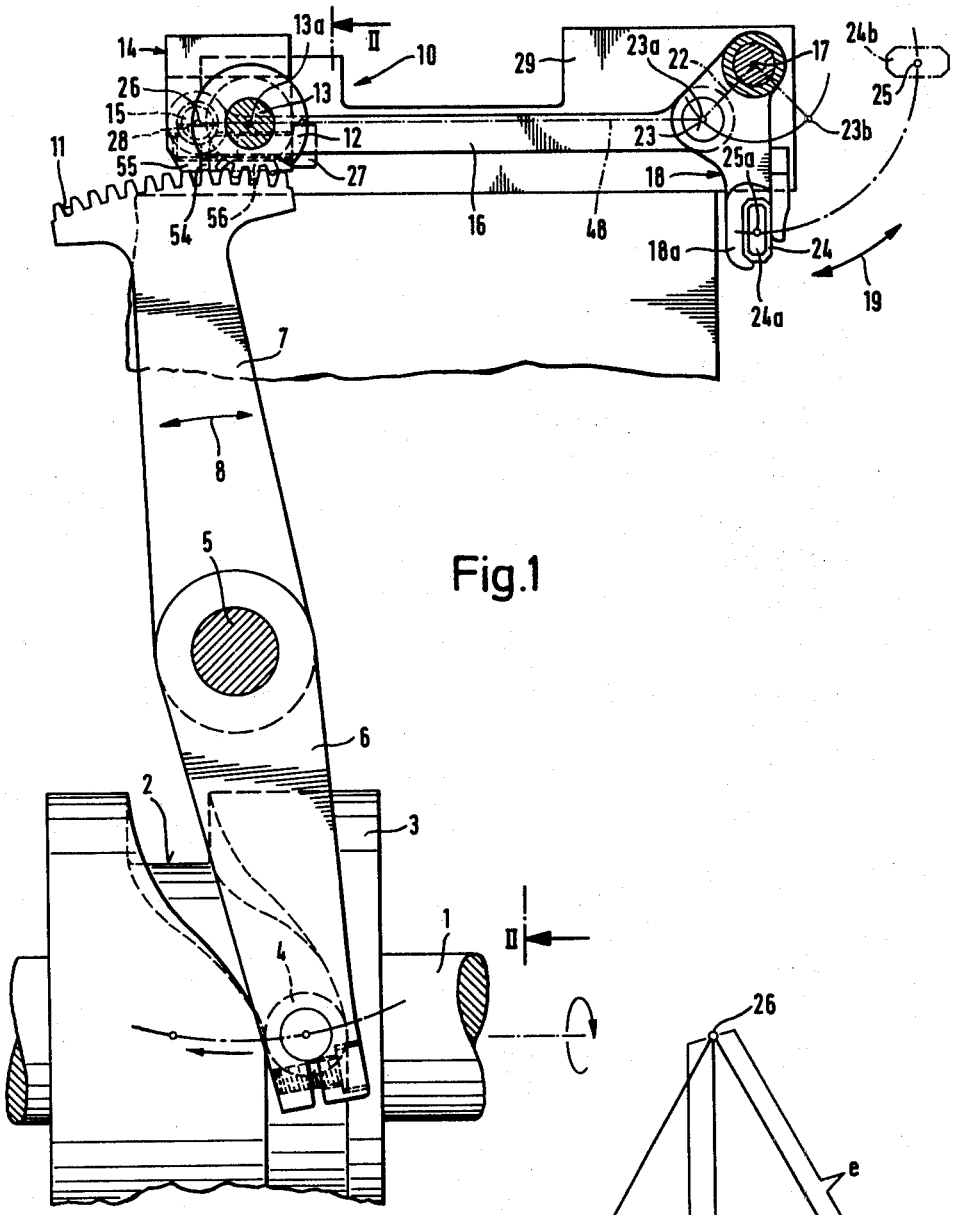
FIG. 1 illustrates a view taken on line I—I of FIG. 2 of a drive mechanism according to the invention.
Figures 4, 5:
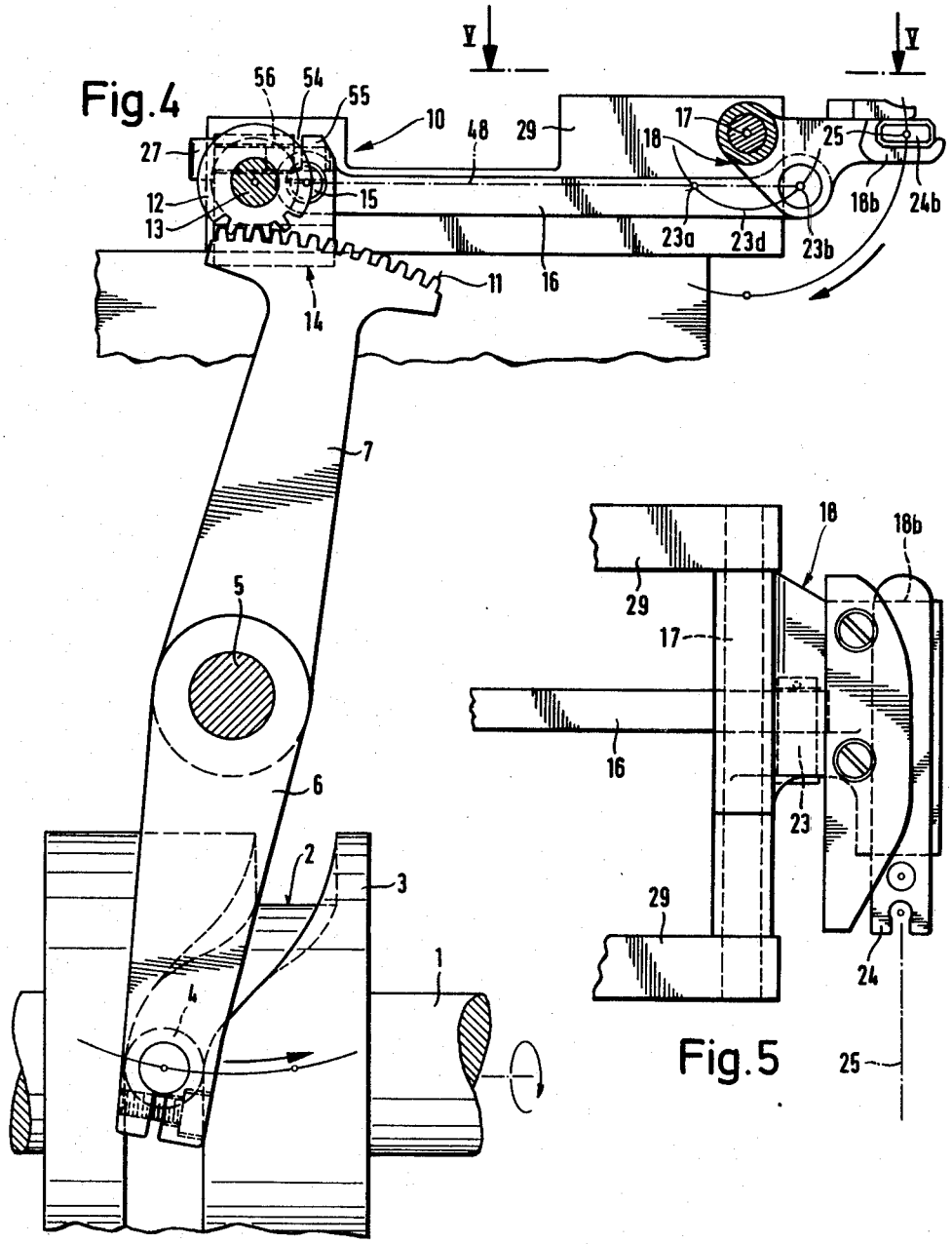
FIG. 4 illustrates a view similar to FIG. 1 of the drive mechanism with a projectile raising cam in an end position in accordance with the invention.
FIG. 5 illustrates a view taken on line V—V of FIG. 4.

Referring to FIG. 1, a weaving machine includes a main drive in the form of a rotatable shaft 1 from which a reciprocable sub-mechanism 18 is moved between a pair of end positions 18*a*, 18*b* (FIG. 4). To this end, a transmission is connected between the main drive shaft 1 and the sub-mechanism 18 for driving of the sub-mechanism from the shaft 1. This transmission includes a crank drive 10 having a crank shaft 13 as well as a toothed gear means for reciprocating the crank shaft 13.

Figure 2:
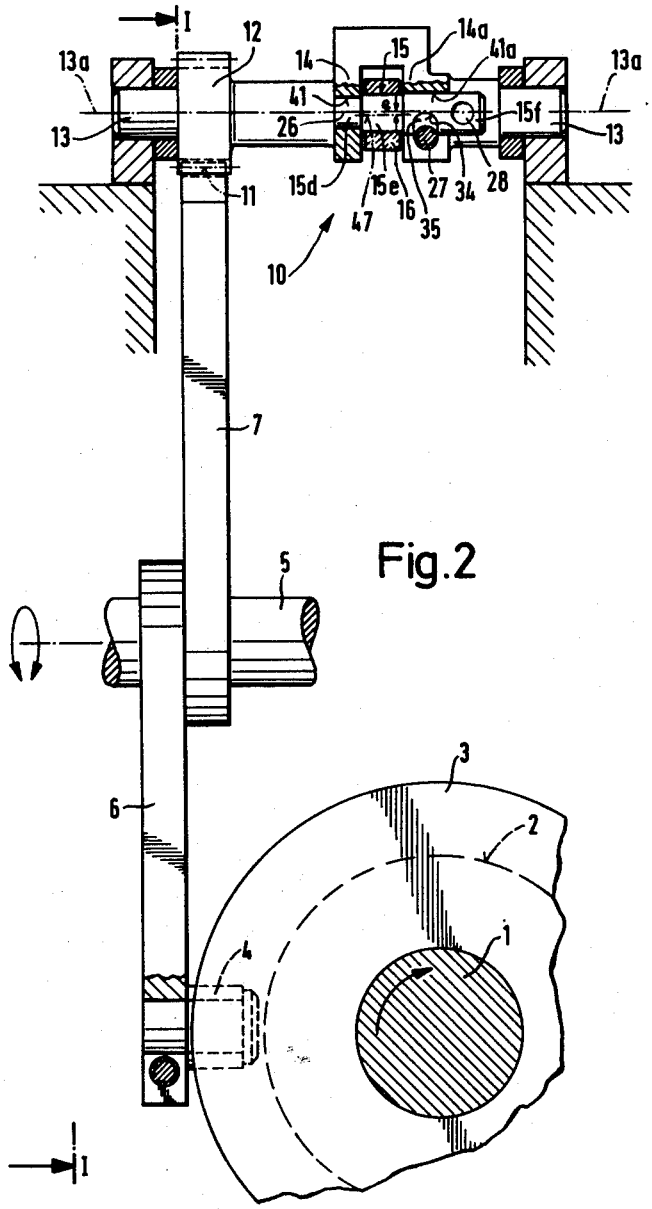
FIG. 2 illustrates a view taken on line II—II of FIG. 1.

As shown in FIG. 2, the crank shaft 13 is fixedly mounted on an axis 13*a* within supports fixed to the weaving machine frame. The toothed gear means includes a gear wheel 12 fixedly mounted on the crank shaft 13, a lever 7 which is pivotally mounted in fixed manner on a pivotal shaft 5, a gear sector 11 which is mounted on the lever 7 in meshing engagement with the gear wheel 12 and a cam drive for pivoting the lever 7 to and fro. As shown, the cam drive includes a drum 3 with a cam groove 2 which is fixed to the shaft 1, a roller 4 which follows the cam groove 2 and a lever 6 which carries the roller 4 and is fixed to the shaft 5. The shaft 1 is rotated continuously from the main weaving machine drive (not shown) so that the two-armed lever 6, 7 is continuously pivoted to and fro.

The crank shaft 13 is drivingly connected to the main drive for oscillation thereby with at least one reversal point of the oscillation movement of the shaft 13 situated near a dead-center position of the crank drive 10.

Figure 7:
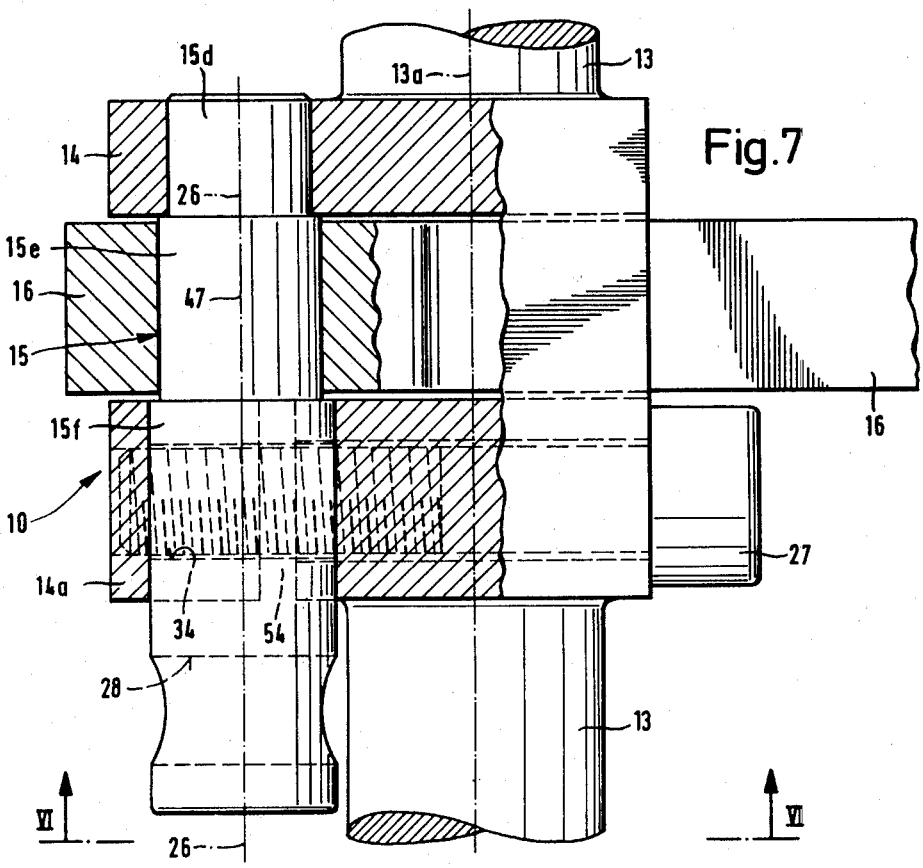
FIG. 7 illustrates a part cross-sectional view of the crank drive components of FIG. 6.

Referring to FIGS. 2 and 7, the crank shaft 13 carries a pair of spaced apart crank webs 14, 14*a* at an intermediate point. These crank webs 14, 14*a* may be fixed to the crankshaft 13 in any suitable manner or may be made integral therewith. In addition, a driving crank pin 15 is journalled in a respective bore of the webs 14, 14*a* and a connecting rod 16 is articulated to the crank pin 15 at one end and to the sub-mechanism 18 at the opposite end. The crank pin 15 is driven from the crank shaft 13 in a reciprocating manner over an arc of 180 degrees so as to be driven between two dead-center positions 15*a*, 15*b* of the crank drive 10 (see FIG. 3). To this end, the crank pin has an eccentric section 15*e* on which the connecting rod 16 is articulated. This eccentric section is adjustable as described below to adjust the point of articulation of the rod 16. The sub-mechanism 18 is in the form of a projectile raising cam 18 which is pivotally mounted about a pin 17 to pivot between two end positions 18*a* (FIG. 1), 18*b* (FIG. 4) in the direction indicated by the arrow 19. When the cam 18 moves from the end position 18*a* to the end position 18*b*, the eccentric crank pin section 15*e* of the crank drive 10 passes through the positions 15*a*, 15*c*, 15*b* as shown diagrammatically in FIG. 3 and the center line 23*d* of the pivot point 23, at which the rod 16 is articulated to the cam 18, passes through the positions 23*a*, 23*c*, 23*b*. The two dead-center positions 15*a*, 15*b* of the crank drive 10 and the corresponding end positions 23*a*, 23*b* and the axis 13*a* of the crank shaft 13 are situated in a common plane 48 which in the present case will be designated as the crank base.

In the case of a small reciprocating movement of the levers 6, 7 and gear wheel 12 in the dead-center positions 15*a*, 15*b*, there is practically no horizontal movement transmitted to the connecting rod 16. The cam 18 thus remains in a complete position of rest in the two end positions 18*a*, 18*b*. These two end positions are thus always exactly the same during operation and are independent of any abutments on the machine frame or any layer of dirt such as flying dust which might otherwise accumulate on such abutments.

Figure 3:
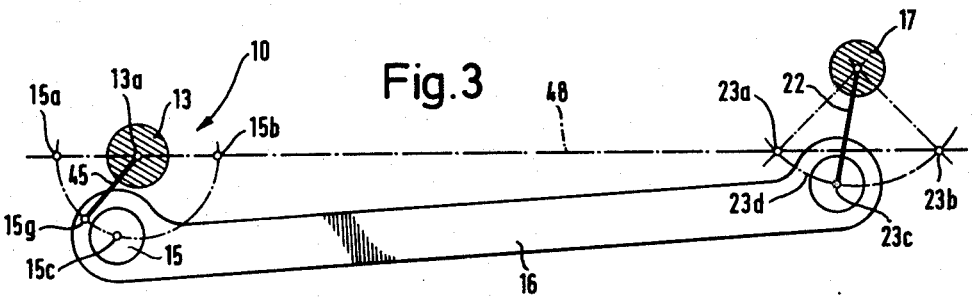
FIG. 3 illustrates a connecting rod of the drive mechanism at an intermediate position in accordance with the invention.

As shown in FIG. 3, the arm 22 of the cam 18 is longer than the crank arm 45 of the crank drive 10. The dimensions are such that pivoting of the crank drive 10 through 180 degrees produces only a 90 degrees pivoting movement at the arm 22 and, hence, of the cam 18. During this movement, a weft picking projectile 24 which is guided into the cam 18 by a return mechanism (not shown) on the weaving machine moves out of the position 24*a* (FIG. 1) into the position 24*b* (FIG. 4). This latter position 24*b* corresponds to a picking line 25. In this position, a weft yarn can be transferred to the projectile 24 so as to be introduced into a shed (not shown). After picking, the empty cam 18 is swung back into the initial position 18*a* (FIG. 1).

As shown in FIGS. 1 and 5, the pin 17 on which the cam 18 is mounted is, in turn, mounted on the supports 29 on which the crank shaft 13 is mounted.

Figure 6:
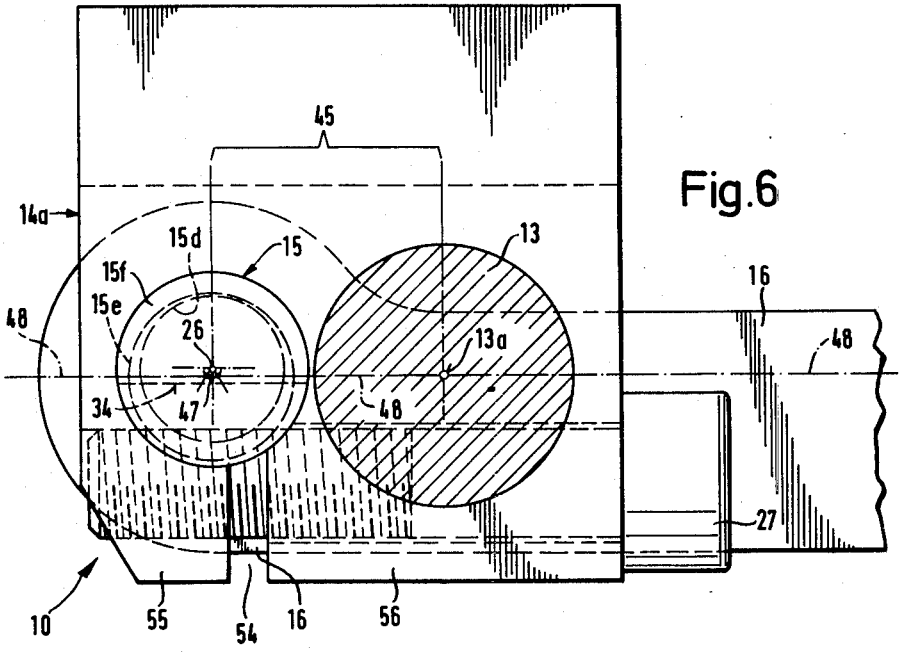
FIG. 6 illustrates an enlarged view of a part of the crank drive of FIG. 1 taken on line VI—VI of FIG. 7.
Figure 8:
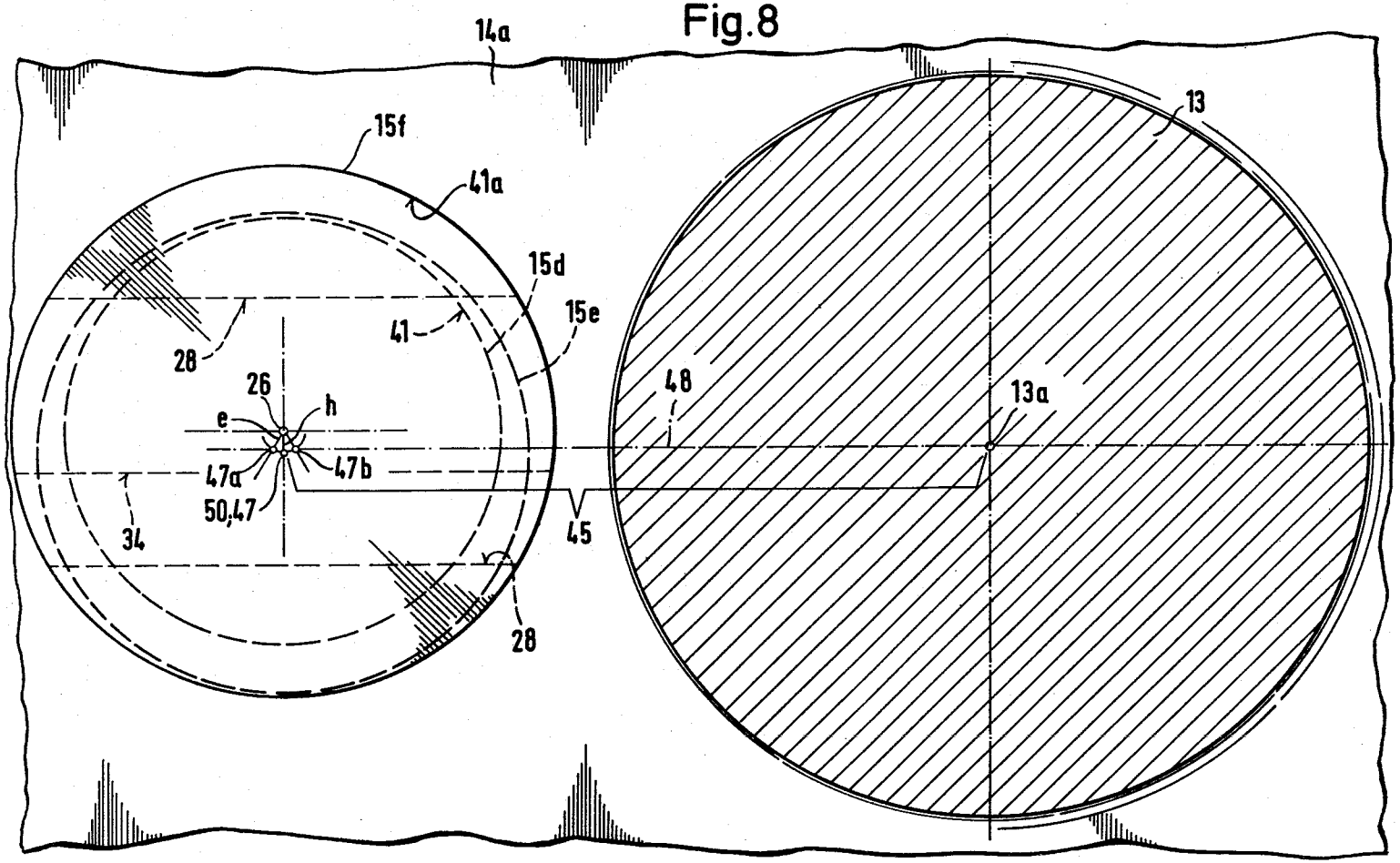
FIG. 8 illustrates a further enlarged view of some of the components of the crank drive of FIG. 6.

Referring to FIGS. 6, 7 and 8, the crank pin 15 consists of three sections 15*d*, 15*e*, 15*f*. The end sections 15*d*, 15*f* are disposed about a common axis 26 coincident with axes of the bores 41, 41*a* in the webs 14, 14*a*. This axis 26 is offset perpendicularly from the base plane 48 (FIG. 8). The eccentric section 15*e* is disposed about an axis 47 which is eccentric to the axis of the pin 15 by an amount e which is substantially equal to the amount of offset h of the axes of the bores (sections 15*d*, 15*f*) from the base plane 48. As indicated in FIG. 8, the axis 26 of the bores 41, 41*a* and the pin sections 15*d*, 15*f* is offset perpendicularly from the base plane 48 when the crank shaft 13 is in either of the dead center positions 15*a*, 15*b*. The amount h of this offset is equal to the distance between the points 50, 26 (FIG. 9), which is approximately equal to the eccentricity e of the eccentric section 15*e*.

The crank drive 10 also has a locking means for locking the eccentric section 15*e* in a fixed position. To this end, as shown in FIGS. 6 and 7, at least the crank web 14*a* has a slot 54 so as to form a pair of free ends 55, 56. In addition, the locking means includes a clamping screw 27 which is threaded into one free end 55 while passing through the other free end 56 for selectively drawing the ends 55, 56 together in order to clamp the crank pin 15 in a fixed position. The crank pin 15 also has a slot 34 (FIG. 2) which permits passage of the clamping screw 27 therethrough. This slot 34 is of a dimension to permit the pivoting movement of the clamping screw 27 between two limit positions.

In order to adjust the eccentric section 15*e*, the screw 27 is first loosened. Thereafter, a tool (not shown) is fitted into a bore 28 in the pin 15 and the pin 15 rotated to the required position. The pin 15 can be turned until one or the other top end surfaces of the recess 34 strikes against the screw 27. These two stop positions correspond to the points 47*a*, 47*b* of FIGS. 8 and 9, each of which is about 30 degrees from the middle point 47. The screw 27 is tightened in the required position and the crank pin 15 is thus locked. This locking means operates in a stepless manner.

Any tolerance in the distance between a crank pin 15 and the pivot point 23 at which the connecting rod 16 is articulated to the cam 18, can thus be compensated when the components of the drive mechanism are assembled. Further, the adjustment of the eccentric section 15*e* of the pin between the points 47*a* and 47*b* enables a relatively large area f (FIG. 9) to be covered in the direction of the connecting rod 16. At the same time, the point 47 where the connecting rod 16 is articulated to the crank pin 15 is prevented from shifting substantially out of the base plane 48, i.e. upwardly or downwardly as viewed in FIGS. 8 and 9. Consequently, the connecting rod 16 and, hence, the cam 18 can occupy changed positions in the two dead-center positions 18*a*, 18*b* due to inevitable play in the drum 3, levers 6, 7, sector 11 and gear wheel 12. However, their end positions during operation are always exactly identical.

Instead of being shifted upwardly out of the base plane 48 as shown in FIG. 8, the axis 26 of the pin sections 15*d*, 15*f* and the bores 41, 41*a* can be shifted downwardly. The eccentricity e of the eccentric section 15*e* can also be somewhat less or more than the distance h between the points 50, 26 by which the axis 26 is offset from the base plane 48. In this case, the arc 47*a*, 47, 47*b* does not touch the base plane 48 but is situated, for example above or below the plane 48. The eccentricity e and the distance h between the points 50, 26 need not be identical. However, it is advantageous for the two values to be substantially equal because the points 47*a*, 47, 47*b* are then situated substantially in the base plane 48.

If the sub-mechanism driven by the dead-center crank drive 10 is of a different construction, suitable changes can be made. For example, if the sub-mechanism is a sley or reed (not shown) which requires only a single or exact reversal point in its movement program, the crank drive 10 may be driven so that the exact reversal point of the sub-mechanism is situated at only a single dead-center position, e.g. at the point 15*b*. The other reversal point of the sub-mechanism, may, for example, correspond to a crank point 15*g* (FIG. 3) which does not coincide with the other dead-center positions 15*a*.

In modified embodiments, reciprocation of the crank drive 10 can be obtained in some other way than via a grooved drum 3. If required, an additional transmission linkage may be provided between the connecting rods 16 and the arm 22 of the projectile raise cam 18.

Still further, the crank drive may be actuated by means of an eccentric rather than by means of crank webs 14, 14*a* and a crank pin 15. In this case, the crank shaft 13 carries an appropriate eccentric on which the connecting rod 16 is articulated.

Figure 9:
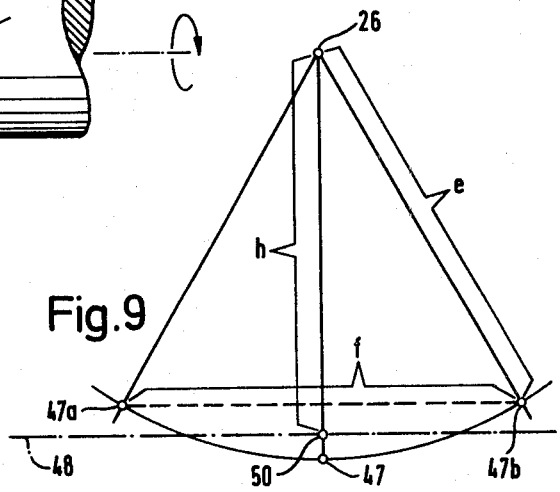
FIG. 9 diagrametically illustrates various dimensional relationships of the crank drive components according to the invention.

The position of the axis 47 of the section 15*e* of the crank pin 15 is in FIGS. 8 and 9 indicated by 50. Point 50 is situated exactly on base plane 48.

What is claimed is:

1. In combination, a reciprocable sub-mechanism for movement between a pair of end positions;

a main drive; and a transmission connected between said main drive and said sub-mechanism for driving of said sub-mechanism from said main drive; said transmission including a crank drive having a crank shaft drivingly connected to said main drive for oscillation thereby with at least one reversal point of the oscillation movement of said crank shaft in the region of a dead-center position of said crank drive.

2. The combination as set forth in claim 1 wherein said crank drive further includes a driving crank pin driven from said crank shaft in a reciprocating manner over an arc of 180 degrees and a driven connecting rod articulated on said crank pin and drivingly connected to said sub-mechanism.

3. The combination as set forth in claim 2 wherein said crank pin has an eccentric section with said rod articulated thereon, said eccentric section being adjustable to adjust the point of articulation of said rod.

4. The combination as set forth in claim 3 wherein said dead-center position of said crank drive and an axis of said crank shaft are located in a common crank base plane, and wherein said crank drive further includes a pair of crank webs fixed to said crank shaft, each said web having a bore journalling said crank pin therein on an axis offset perpendicularly from said base plane.

5. The combination as set forth in claim 4 wherein said eccentric section is eccentric to the axis of said pin by an amount (e) substantially equal to the amount of offset (h) of said axes of said bores from said base plane.

6. The combination as set forth in claim 5 which further includes a locking means for locking said eccentric section in a fixed position.

7. The combination as set forth in claim 6 wherein said locking means is stepless.

8. The combination as set forth in claim 7 wherein at least one crank web is slotted to have a pair of free ends and said locking means includes a clamping screw threaded into one of said free ends and passing through the other of said free ends for selectively drawing said ends together to clamp said crank pin in a fixed position.

9. The combination as set forth in claim 8 wherein said crank pin has a slot permitting passage of said clamping screw therethrough, said slot being of a dimension to permit a pivoting movement of said clamping screw therein between two limit positions.

10. The combination as set forth in claim 2 wherein said sub-mechanism includes a projectile raising cam pivotally mounted to move between said pair of end positions with said connecting rod articulated to said cam at a given point, said point being disposed in a common base plane with said cam in either of said end positions, and wherein said crank shaft has an axis located in said base plane.

11. The combination as set forth in claim 1 wherein said transmission includes a toothed gear means for reciprocating said crank shaft.

12. The combination as set forth in claim 11 wherein said toothed gear means includes a gearwheel fixedly mounted on said crank shaft, a pivotally mounted lever, a gear sector mounted on said lever in meshing engagement with said gearwheel and a cam drive for pivoting said lever to and fro.

13. A drive mechanism comprising a crank shaft having an axis located in a given base plane and being oscillable between two reversal points;

a pair of crank webs mounted on said crank shaft, each said web having a bore therein on an axis spaced perpendicularly from said base plane with said crank shaft at either of said reversal points;

a crank pin mounted in said webs in each respective bore thereof, said pin having an eccentric section with an axis disposed substantially in said base plane with said crank at one of said reversal points; and a connecting rod articulated on said crank pin between said webs.

14. A drive mechanism as set forth in claim 13 wherein said axis of said eccentric section is eccentric to said axes of said bores of said webs by an amount substantially equal to the spacing between said axis of a bore of a respective web and said base plane with said crank shaft at either of said reversal points.

15. A drive mechanism as set forth in claim 13 wherein at least one of said webs is slotted to form a pair of free ends and a clamping screw is threaded into one of said free ends and passes through the other of said free ends for selectively drawing said ends together to clamp said crank pin in a fixed position.

16. A drive mechanism as set forth in claim 15 wherein said crank pin has a slot permitting passage of said clamping screw therethrough, said slot being of a dimension to permit a pivoting movement of said clamping screw therein between two limit positions.

17. A drive mechanism as set forth in claim 13 further comprising means for oscillating said crank shaft between said reversal points.

* * * * *